United States Patent [19]

Dunagan

[11] Patent Number: 4,593,874

[45] Date of Patent: Jun. 10, 1986

[54] ADJUSTABLE LEGS FOR DESKS AND FURNITURE

[76] Inventor: Lawrence G. Dunagan, 11023 Telephone Rd., Houston, Tex. 77075

[21] Appl. No.: 654,969

[22] Filed: Sep. 27, 1984

[51] Int. Cl.[4] ..... A47F 5/00

[52] U.S. Cl. ..... 248/188.4; 108/147

[58] Field of Search ..... 248/188.4, 188.5, 157; 108/144, 147; 312/312, 21, 22

[56] References Cited

U.S. PATENT DOCUMENTS

| | | | |
|---|---|---|---|
| 1,943,280 | 1/1934 | Arnold | 108/147 |
| 2,609,768 | 9/1952 | Cash et al. | 108/147 X |
| 3,356,327 | 12/1967 | Schreyer et al. | 248/188.4 |
| 3,385,238 | 5/1968 | Jay | 108/144 X |
| 3,565,501 | 2/1971 | Bowen et al. | 248/188.4 |
| 3,888,444 | 6/1975 | Yindia et al. | 248/188.5 |

*Primary Examiner*—Robert W. Gibson, Jr.
*Attorney, Agent, or Firm*—Kenneth A. Roddy

[57] ABSTRACT

A set of adjustable legs for raising and lowering desks and other furniture comprises outer tubular members attachable to the desk or other furniture and inner tubular members slidably and non-rotatably received within the outer members and adapted for vertical movement relative thereto. A threaded shaft having a sprocket on its upper portion is rotatably mounted within the members for moving the inner member relative to the outer member, and a chain interconnects the sprockets of each of the shafts for simultaneous rotational movement to move the inner member along the shaft and thereby raise and lower the desk. The legs may be operated by an electric motor or hand crank connected to the chain.

12 Claims, 5 Drawing Figures

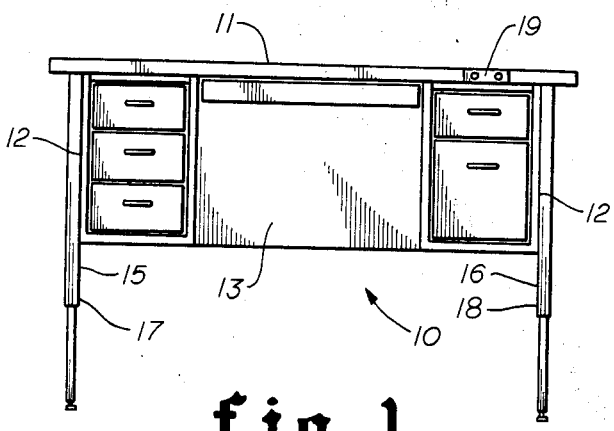
fig.1
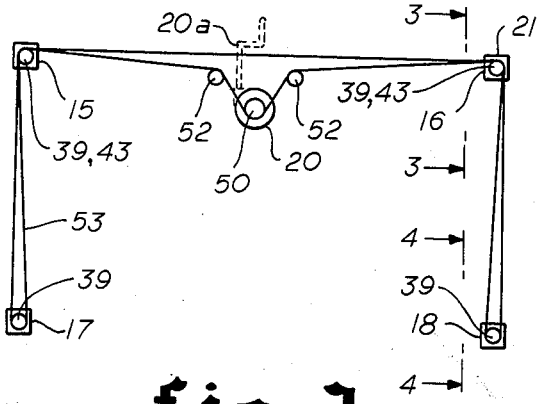
fig.2
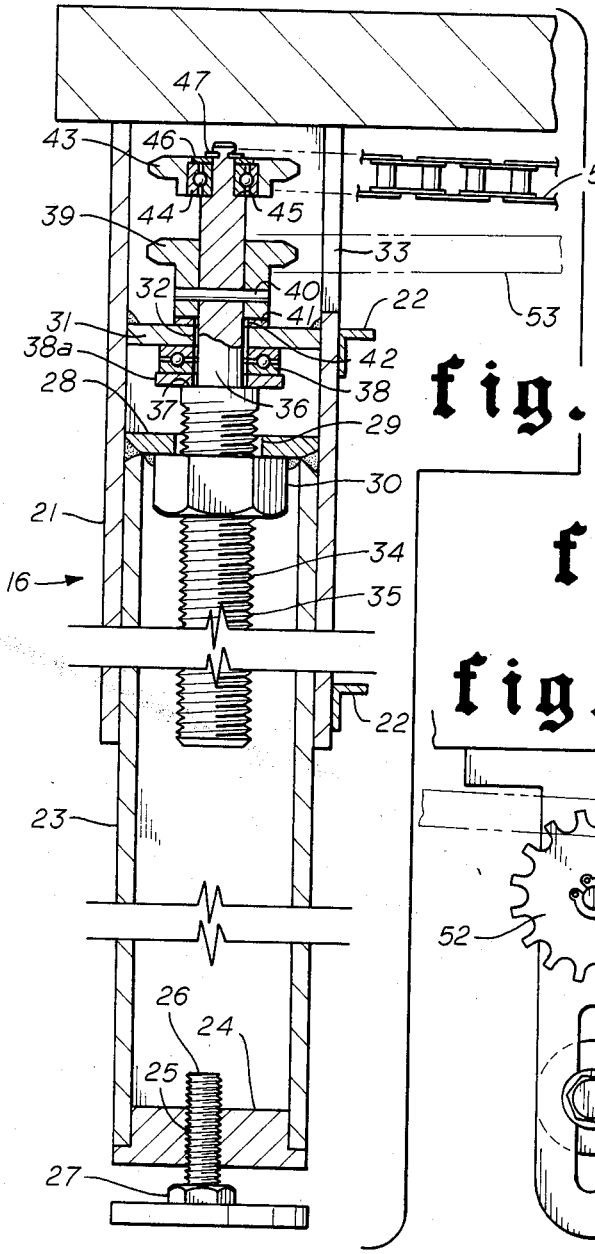
fig.3
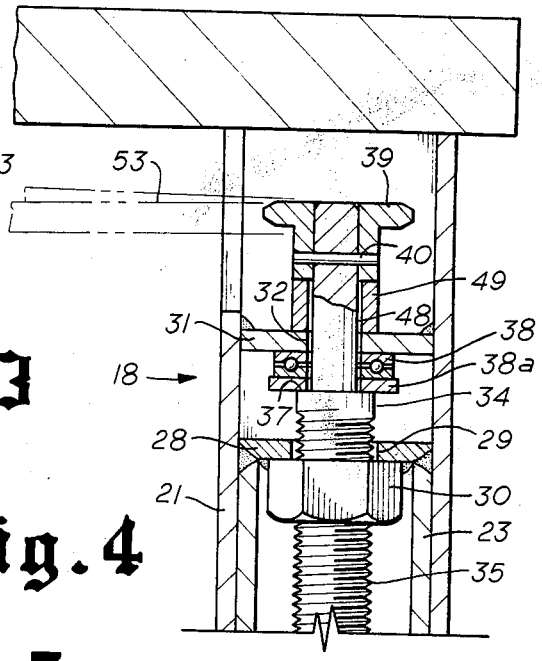
fig.4
fig.5
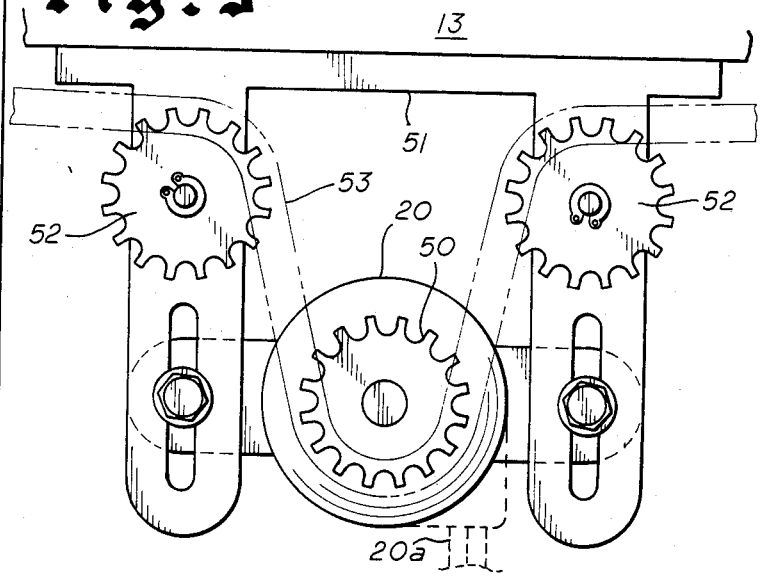

ADJUSTABLE LEGS FOR DESKS AND FURNITURE

BACKGROUND OF THE INVENTION

1. Field of the Invention

This invention relates to height adjusting devices, and more particularly to a set of adjustable legs for desks and other furniture.

2. Brief Description of the Prior Art

Sitting at a desk or work table for prolonged periods of time is a common cause of neck, shoulder and back pain. It is common practice for desk users to employ adjustable chairs and stools which offer limited adjustments in height relative to the desk. The adjustment of the chair or stool is largely a matter of compromise and often unsatisfactory due to the wide variations in height and physical characteristics of the user.

Desks having height adjustment means are known in the art. There are several patents which disclose various height adjusting mechanisms which offer limited height adjustment of desks and other furniture.

Brown, U.S. Pat. No. 2,544,822 discloses an adjustable base for desks. The base is provided with an elongated base member containing a vertically sliding bar-like foot piece having upwardly inclined slots which carry a cam plate. An adjusting screw co-acts with a nut on the cam plate whereby rotation of the screw moves the cam plate longitudinally to raise and lower the base relative to the foot piece.

Fox, U.S. Pat. No. 2,545,949 discloses a desk elevator comprising a pair of elongated island type support members. The support members consist of a spring connected base member and top member having opposed inwardly inclined surfaces at each end. A threaded shaft is turned by a screw driver to move a pair of opposed wedge members inwardly on the inclined faces thereby separating the base and top members to raise and lower the desk.

Blumenberg, U.S. Pat. No. 1,762,046 discloses an adjustable car seat wherein a conventional hand crank jack operates a set of pivotally mounted levers to raise and lower the seat.

Stevens, U.S. Pat. No. 3,606,255 discloses a scissors jack which is raised and lowered by rotation of a pair of parallel threaded rods. A chain is connected to sprockets mounted on each rod whereby force transmitted to one of the rods is transmitted to the other. The parallel drive means reduces torsional forces and frictional loads to permit level raising and lowering even though the jack may be supporting an unbalanced load.

Adamson, Jr., U.S. Pat. No. 3,976,281 discloses a variable height work surface which is adjustable from a low profile to a desired level by utilizing double acting scissor legs controlled by a screw mechanism.

The prior art in general, and none of these patents in particular, disclose a set of adjustable legs for raising and lowering desks and other furniture comprising outer tubular members attachable to the desk or other furniture and inner tubular members slidably and non-rotatably received within the outer members and adapted for vertical movement relative thereto, a threaded shaft having a sprocket on its upper portion and rotatably mounted within the members for moving the inner member relative to the outer member, and a chain interconnecting the sprockets of each of the shafts for simultaneous rotational movement to move the inner member along the shaft and thereby raise and lower the desk.

SUMMARY OF THE INVENTION

It is therefore an object of the present invention to provide adjustable legs for desks and other furniture which quickly and easily adjust the height of the work surface relative to the floor or sitting height to more efficiently adapt to variations in the physical characteristics of the user.

It is another object of this invention to provide adjustable legs for desks and other furniture which allow the working surface to be selectively used from a sitting position or a standing position thereby reducing neck, shoulder, and back pain due to sitting at the work surface for prolonged periods of time.

Another object of this invention is to provide adjustable legs for desks and other furniture which allow all the legs to be adjusted simultaneously.

A further object of this invention is to provide adjustable legs for desks and other furniture which may be adjusted by an electric motor or by a hand crank.

A still further object of this invention is to provide adjustable legs for desks and other furniture which are simple in construction, economical to manufacture, and capable of supporting relatively heavy loads.

Other objects of the invention will become apparent from time to time throughout the specification and claims as hereinafter related.

The above noted objects and other objects of the invention are accomplished by a set of adjustable legs for raising and lowering desks and other furniture comprising outer tubular members attachable to the desk or other furniture and inner tubular members slidably and non-rotatably received within the outer members and adapted for vertical movement relative thereto, a threaded shaft having a sprocket on its upper portion and rotatably mounted within the members for moving the inner member relative to the outer member, and a chain interconnecting the sprockets of each of the shafts for simultaneous rotational movement to move the inner member along the shaft and thereby raise and lower the desk. The legs may be operated by an electric motor or hand crank connected to the chain.

BRIEF DESCRIPTION OF THE DRAWINGS

FIG. 1 is a front elevational view of a desk having adjustable legs in accordance with the present invention.

FIG. 2 is a schematic top plan view of the drive system for of the adjustable legs FIG. 3 is a longitudinal cross sectional view of one of the adjustable legs.

FIG. 4 is a longitudinal cross sectional view of another one of the adjustable legs.

FIG. 5 is a top plan view of the drive motor for the adjustable legs.

DESCRIPTION OF THE PREFERRED EMBODIMENT

Referring now to the drawings by numerals of reference, there is shown a desk 10 having a top 11, side walls 12, and a back wall 13. A front pair of adjustable legs 15 and 16 and a back pair of adjustable legs 17 and 18 are attached to the side walls 12 to extend vertically downwardly from the underside of the desk top 11 and terminate below the side walls. A control switch 19 is attached at a convenient location on the desk 10 for controlling the operation of an electric drive motor 20 to raise and lower the desk 10 relative to the floor. The motor 20 may be provided with a manual override or hand crank mechanism 20*a* to raise and lower the legs. The adjustable legs of the present invention may be attached to various styles of desks and other legged furniture.

The front pair of adjustable legs 15 and 16 are identical in construction and one leg 16 is shown in FIG. 3. The front adjustable leg 16 comprises an open ended elongated square outer tubular member 21 having attachment means 22 disposed on one side wall for attaching the outer tubular member to the side wall 12 of the desk 10. A clip type attachment means is illustrated, but it should be understood that any conventional leg attachment means used in furniture construction may be used without departing from the scope of the invention.

The outer tubular member 21 extends substantially the length of the side wall 12 and telescopically receives a mating elongated square inner tubular member 23. The bottom end of the inner tubular member 23 is enclosed by an end cap 24 having a central threaded bore 25 which threadably receives the shaft 26 of a leveling pad 27. The leveling pad 27 is turned to make minor height adjustments independently on each leg for making the desk top 11 level.

The top end of the inner tubular member 23 is enclosed by a square top plate 28 having a central bore 29. A threaded nut 30 having a threaded bore smaller than the bore 29 is welded to the underside of the top plate 28. A square stop plate 31 having a central bore 32 is welded to the interior walls near the top of the outer tubular member 21. Two adjacent side walls of the outer tubular member 21 are cut away to provide slots or vertical openings 33 which allow passage of a chain therethrough, as explained hereinafter.

A threaded shaft 34 having an elongated threaded lower portion 35 and a smooth first reduced diameter upper portion 36 is disposed centrally within the outer tubular member 21. The threaded portion 35 is threadably received within the threaded bore of the nut 30 and passes through the bore 29. The reduced diameter portion 36 extends upwardly through the bore 32. A shoulder 37 is defined between the threaded portion 35 and the reduced diameter portion 36. A thrust bearing 38 and bushing 38*a* are operably received between the shoulder 37 and the underside of the stop plate 31. A chain drive sprocket 39 is secured onto the reduced diameter 36 by means of a pin 40. A flat circular bushing 41 having a central bore 42 is received on the reduced diameter 36 beneath the sprocket 39.

A free turning idler sprocket 43 is carried by a bearing 44 disposed on a second shoulder 45 above the drive sprocket 39. A flat circular washer 46 covers the assembled bearing and a snap ring 47 retains the assembly in place on the shaft 34.

The back pair of adjustable legs 17 and 18 are identical in construction to the leg shown in FIG. 3 with the exception of the sprocket assembly, and the same description and reference numerals of identical parts apply to the front leg 18 shown in FIG. 4. The back adjustable legs 17 and 18 do not require an idler sprocket, and the upper portion of the threaded shaft 34 is constructed differently.

The threaded lower portion 35 of the shaft 34 is provided with a reduced diameter upper portion 48 which extends upwardly through the bore 32. A shoulder 37 is defined between the threaded portion 35 and the reduced diameter portion 48. A thrust bearing 38 and bushing 38*a* are operably received between the shoulder 37 and the underside of the stop plate 31. A chain drive sprocket 39 is secured onto the reduced diameter 48 by means of a pin 40. A spacer bushing 49 is received on the reduced diameter 48 beneath the sprocket 39. The spacer bushing 49 is of suitable length to place the drive sprocket 39 at the appropriate height to reduce binding of a chain connecting all four of the drive sprockets and idler sprockets as described hereinafter. In this manner, the spacer bushing 49 allows all of the legs to be cut and welded to the same specifications.

FIG. 5 shows an electric drive motor 20 having a drive sprocket 50 mounted on a bracket 51 attached to the front wall 13 of the desk 10. A pair of free turning idler sprockets 52 are rotatably mounted on the bracket 51. The motor 20 is adjustably mounted in a conventional manner for horizontal movement relative to the idler sprockets 52 for applying tension in the chain 53 which connects the drive sprockets of all the legs. The motor 20 may be provided with a manual override or hand crank mechanism 20*a* to be used when electricity is not available or convenient. It should be understood that the hand crank 20*a* could also be used in place of the electric motor 20.

OPERATION

As illustrated in FIG. 2, the legs are assembled in a collapsed nested position on the desk side walls 12 and a length of bicycle chain 53 is passed around the idler sprockets 52 on the motor mounting bracket 51, the motor drive sprocket 50, and around the drive sprockets 39 of the front pair of legs 15 and 16. The chain 53 is then passed around the drive sprockets 39 of the back pair of legs 17 and 18, then back around the idler sprockets 43 on the front pair of legs, and finally the ends of the chain 53 are connected to form an endless loop. The motor 20 is adjusted relative to the idler sprockets 52 to apply the proper amount of tension to the chain.

The motor 20 when activated by the control switch 19 rotates the motor drive sprocket 50 which simultaneously turns the leg drive sprockets 39 to drive the nut 30 up and down along the threaded shaft 34. The nut 30 is secured to the inner tubular member 23 whereby rotary motion of the shafts 34 will move the inner tubular member inward or outward of the outer tubular member 28 depending upon the direction of rotation. This action will raise and lower the desk 10 relative to the floor. The legs according to the present invention will raise the desk approximately 12 to 14 inches from its initial lowered position.

While this invention has been described fully and completely with special emphasis upon a preferred embodiment, it should be understood that within the scope of the appended claims the invention may be practiced otherwise than is specifically described herein.

I claim:

1. A set of adjustable legs for raising and lowering desks and other furniture comprising;

open ended elongated square outer tubular members of thin wall metal tubing having attachment means disposed on at least one side wall for attaching said outer tubular members to the side wall of said desks and other furniture, said outer tubular member enclosed near its top end by a stop plate member having a central aperture, a mating elongated square inner tubular member of thin wall metal tubing slidably and non-rotatably telescopically received within each said outer tubular member and adapted for vertical movement relative thereto, said inner tubular member enclosed at its top end by a top plate member and at its bottom end by an end cap member each having a central threaded aperture, a shaft rotatably disposed within each said outer and inner tubular member for moving said inner member relative to said outer member, said shaft having an elongated threaded lower portion and a first smooth reduced diameter upper portion defining an annular shoulder therebetween, said lower portion threadedly received within the threaded aperture of said top plate member of said inner member and said first smooth reduced diameter upper portion extending rotatably through said stop plate of said outer tubular member, bearing means operably disposed on said reduced diameter between said shoulder and the underside of said plate of said outer member, a drive transmitting sprocket secured to each said shaft for receiving and transmitting rotary motion thereto, a chain operatively interconnecting each said drive sprocket for rotating each said shaft simultaneously, rotary drive means connected to said chain for imparting rotary motion thereto whereby rotation of said chain and said shaft moves said inner member vertically along said threaded portion relative to said outer member, at least one said shaft having a second reduced diameter portion spaced above the first reduced diameter forming a shoulder therebetween and a free turning idler sprocket journaled thereon for rotary motion relative thereto, said chain interconnecting said sprocket for rotating said sprocket indepent of said at least one shaft, and leveling means threadedly received within the threaded aperture of each said end cap member at the bottom of each said inner tubular member for vertical movement relative thereto for selectively and independently adjusting the height of said inner tubular member relative to the floor to maintain said desks and other furniture in a level position.

2. The adjustable legs according to claim 1 wherein said rotary drive means comprises an electric motor having a drive sprocket connected to said chain, associated control switches for controlling the direction of rotation thereof, and adjusting means for adjusting the tension in said chain.

3. The adjustable legs according to claim 1 wherein two adjacent side walls of said outer tubular member are cut away to provide apertures which allow passage of said chain therethrough.

4. The adjustable legs according to claim 1 wherein said chain operatively connects said drive sprocket of said rotary drive means, said drive sprockets of each said shaft, and said idler sprockets in an endless loop.

5. The adjustable legs according to claim 1 wherein said rotary drive means comprises a hand crank assembly having a drive sprocket operatively connected to said chain for imparting rotational movement thereto.

6. The adjustable legs according to claim 2 wherein said electric motor includes a hand crank assembly operatively connected thereto for selectively imparting rotational movement to said chain.

7. A vertically adjustable desk comprising;

a set of telescoping adjustable legs each having an open ended elongated square outer member of thin wall metal tubing secured to at least one side wall of said desks and other furniture and a mating elongated square inner member of thin wall metal tubing slidably and nonrotatably telescopically received within each said outer member and adapted for vertical movement relative thereto for raising and lowering said desk, said outer tubular member enclosed near its top end by a stop plate member having a central aperture, said inner tubular member enclosed at its top end by a top plate member and at its bottom end by an end cap member each having a central threaded aperture, a shaft rotatably disposed within each said outer and inner tubular member for moving said inner member relative to said outer member, said shaft having an elongated threaded lower portion and a first smooth reduced diameter upper portion defining an annular shoulder therebetween, said lower portion threadedly received within the threaded aperture of said top plate member of said inner member and said first smooth reduced diameter upper portion extending rotatably through said stop plate of said outer tubular member, bearing means operably disposed on said reduced diameter between said shoulder and the underside of said plate of said outer member, a drive sprocket secured to each said shaft for receiving and transmitting rotary motion thereto, a chain operatively interconnecting each said drive sprocket for rotating each said shaft simultaneously, rotary drive means connected to said chain for imparting rotary motion thereto whereby rotation of said chain and said shaft moves said inner member vertically along said threaded portion relative to said outer member, at least one said shaft having a second reduced diameter portion spaced above the first reduced diameter forming a shoulder therebetween and a free turning idler sprocket journaled thereon for rotary motion relative thereto, said chain interconnecting said sprocket for rotating said sprocket indepent of said at least one shaft, and leveling means threadedly received within the threaded aperture of each said end cap member at the bottom of each said inner tubular member for vertical movement relative thereto for selectively and independently adjusting the height of said inner tubular member relative to the floor to maintain said desks and other furniture in a level position.

8. The desk according to claim 7 wherein said rotary drive means comprises an electric motor having a drive sprocket connected to said chain, associated control switches for controlling the direction of rotation thereof, and adjusting means for adjusting the tension in said chain.

9. The desk according to claim 7 wherein two adjacent side walls of said outer tubular member are cut away to provide apertures which allow passage of said chain therethrough.

10. The desk according to claim 7 wherein said chain operatively connects said drive sprocket of said rotary drive means, said drive sprockets of each said shaft, and said idler sprockets in an endless loop.

11. The desk according to claim 7 wherein said rotary drive means comprises a hand crank assembly having a drive sprocket operatively connected to said chain for imparting rotational movement thereto.

12. The desk according to claim 8 wherein said motor includes a hand crank assembly operatively connected thereto for selectively imparting rotational movement to said chain.

* * * * *